US009147946B1

(12) United States Patent
Wong

(10) Patent No.: US 9,147,946 B1
(45) Date of Patent: Sep. 29, 2015

(54) ELECTRICAL CABLE CONNECTOR

(71) Applicant: Memie Mei Mei Wong, Hong Kong (CN)

(72) Inventor: Memie Mei Mei Wong, Hong Kong (CN)

( * ) Notice: Subject to any disclaimer, the term of this patent is extended or adjusted under 35 U.S.C. 154(b) by 0 days.

(21) Appl. No.: 14/291,308

(22) Filed: May 30, 2014

(51) Int. Cl.
*H01R 4/24* (2006.01)

(52) U.S. Cl.
CPC ..... *H01R 4/2404* (2013.01)

(58) Field of Classification Search
CPC ... H01R 4/2412; H01R 4/2433; H01R 23/025
USPC ..... 439/410, 402, 409, 403, 401, 418
See application file for complete search history.

(56) References Cited

U.S. PATENT DOCUMENTS

| | | | | |
|---|---|---|---|---|
| 5,601,448 | A | 2/1997 | Poon | |
| 5,888,090 | A * | 3/1999 | Achee | 439/417 |
| 5,975,938 | A * | 11/1999 | Libby | 439/410 |
| 6,159,035 | A * | 12/2000 | Smith, III | 439/391 |
| 6,364,690 | B1 | 4/2002 | Nehm-Engelberts | |

* cited by examiner

*Primary Examiner* — Phuong Dinh
(74) *Attorney, Agent, or Firm* — Leydig, Voit & Mayer, Ltd.

(57) ABSTRACT

An electrical cable connector has a body having first and second body members that are movable between open and closed positions of the body, and first and second conductors supported by the first and second body members, respectively. The two conductors have respective ends protruding from the respective body members. When the body members are moved to the closed position of the body, the ends of the conductors simultaneously cut through insulation and come into electrical connection with two cores of a first cable. A connecting element electrically connects the conductors to respective cores of a second electrical cable.

21 Claims, 20 Drawing Sheets

ELECTRICAL CABLE CONNECTOR

The present invention relates to an electrical cable connector that is particularly but not exclusively useful for power connection of garden lights in a landscape lighting system.

BACKGROUND OF THE INVENTION

Along a low-voltage 12V DC (or AC) power supply cable of a landscape lighting system, it is possible to draw electrical power from the cable at any desired position for supplying power to an electrical device and in particular a lighting fixture in a garden or front/back yard where lighting is desired. A specific type of electrical connectors is used for this purpose, which is mounted on the cable at that position and is then screwed tight to pierce a pair of sharp pins into the cable cores for extracting power.

Connectors of this type are known in general, for example as disclosed in U.S. Pat. Nos. 5,601,448 and 6,364,690, but they are not convenient to use, for example the cable leading to the electrical device is cumbersome to connect or disconnect. Such connectors are often material and/or labour intensive to manufacture.

The invention seeks to mitigate or at least alleviate such shortcomings by providing a new or improved electrical cable connector.

SUMMARY OF THE INVENTION

According to the invention, there is provided an electrical cable connector for electrically connecting a second electrical cable to a first electrical cable having two cores with insulation. The electrical cable connector has a body having a first body member and a second body member which are connected together and are movable from an open position in which the first and second body members are relatively spaced apart to a closed position in which the first and second body members are relatively close together. Included are a first conductor supported by the first body member and a second conductor supported by the second body member. The first and second conductors have respective ends protruding from the corresponding first and second body members, the ends pointing in opposite directions along an imaginary plane when the first and second body members are in the closed position. Further included is a gap associated with at least one of the first and second body members, through which gap the imaginary plane extends, for receiving and locating a section of the two cores of a said first electrical cable on the same imaginary plane when the first and second body members are moved to the closed position with the ends of the first and second conductors simultaneously cutting through insulation and coming into electrical connection in opposite directions with the two cores respectively. There is also connecting means associated with the first and second body members and adapted to electrically connect each of the first and second conductors to the or a respective core of a said second electrical cable.

Preferably, the first and second body members are connected together for pivotal movement and are pivotable from the open position to the closed position.

More preferably, the first and second body members are distinct parts and are connected together by means of a hinge connection.

More preferably, the first and second body members are integral parts and are integrally connected together by means of a resiliently deformable intermediate part.

It is preferred that the body has a looped configuration when the first and second body members are in the closed position.

It is preferred that the body includes a locking device for locking the first and second body members in the closed position against a resiliently biasing force which resiliently biases the first and second body members towards the open position.

It is further preferred that the locking device comprises a releasable latch for latching to lock the first and second body members in the closed position, the latch including a releasing part for deformation to release the latch.

Preferably, the gap is formed between two opposed gap parts provided by at least one of the first and second body members.

More preferably, the gap parts are provided by both the first and second body members, one gap part from each body member.

More preferably, the gap parts are both provided by the second body member.

In a preferred embodiment, said at least one of the gap parts has an inner surface which is resiliently movable to adjust the width of the gap.

More preferably, the inner surface of said at least one of the gap parts is provided by a resiliently flexible plate.

It is further preferred that the resiliently flexible plate implements said at least one of the gap parts.

It is further preferred that said at least one of the gap parts includes a wall on the associated body member and supporting the resiliently flexible plate, the wall and the resiliently flexible plate together implementing said at least one of the gap parts.

In a preferred embodiment, the connecting means comprises respective second ends of the first and second conductors protruding from the corresponding first and second body members and pointing in opposite directions along a second imaginary plane when the first and second body members are in the closed position, and a second gap equivalent to the first-mentioned gap, through which second gap the second imaginary plane extends, for receiving and locating a section of two cores with insulation of a said second electrical cable on the same second imaginary plane when the first and second body members are moved to the closed position with the second ends of the first and second conductors simultaneously cutting through insulation and coming into electrical connection in opposite directions with the two cores respectively of a said second electrical cable.

In another preferred embodiment, the connecting means comprises respective second ends of the first and second conductors at the corresponding first and second body members, and a connecting device for connecting the or a respective core of a said second electrical cable to the second end of at least one of the first and second conductors.

More preferably, the connecting device comprises a movable member on one of the first and second body members and adjacent the second end of the associated first or second conductor, the movable member having an engaging part adapted to engage the or a respective core of a said second electrical cable and, upon movement of the movable member, to connect it to the second end of the associated first or second conductor.

Further more preferably, the movable member is in pivotal engagement with said one of the first and second body members for pivotal movement to connect the or a respective core of a said second electrical cable to the second end of the associated first or second conductor.

Further more preferably, the engaging part has a hole or recess for receiving to engage the or a respective core of a said second electrical cable.

Further more preferably, the connecting device comprises a pair of said movable members on the first and second body members respectively for connecting the cores of respective said second electrical cables or respective cores of a said second electrical cable to the second ends of the first and second conductors respectively.

In a preferred construction, each end of at least one of the first and second conductors has a relatively sharp tip or edge for piercing through insulation and coming into electrical connection with the respective core.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
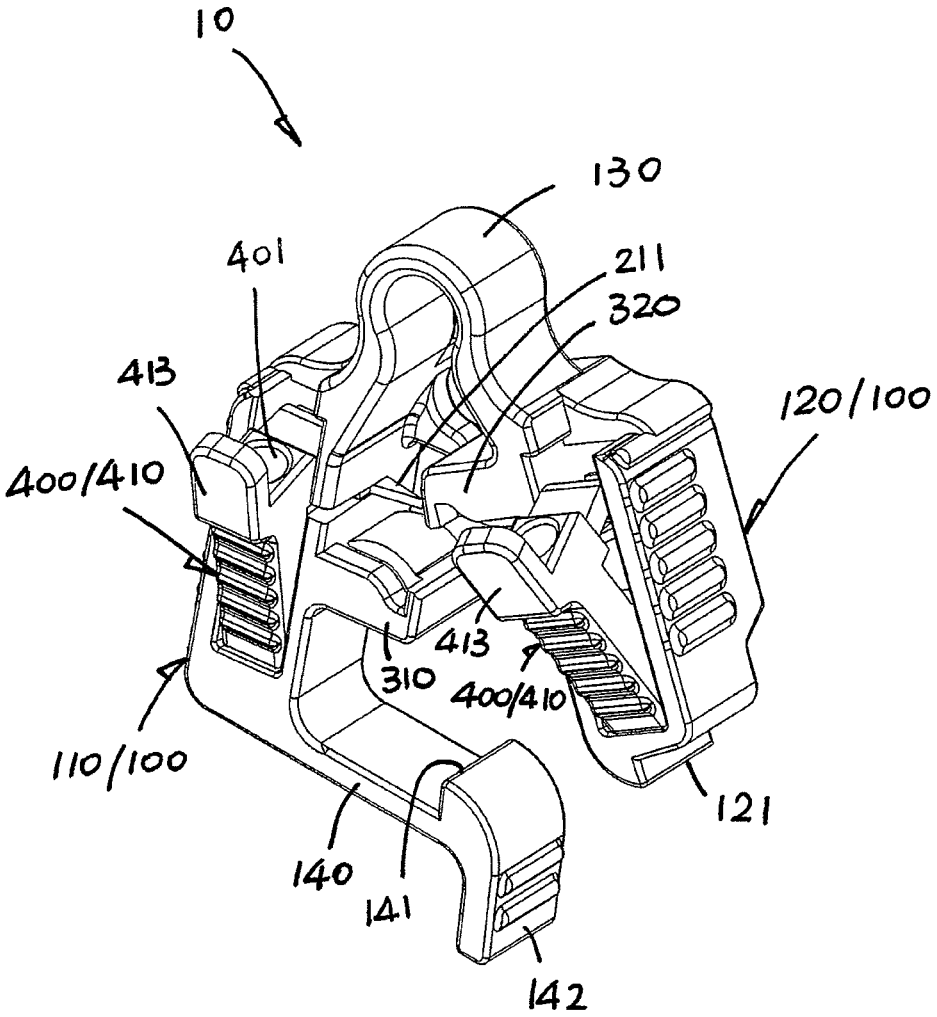
FIG. 1 is a front perspective view of a first embodiment of an electrical cable connector in accordance with the invention.
Figure 2:
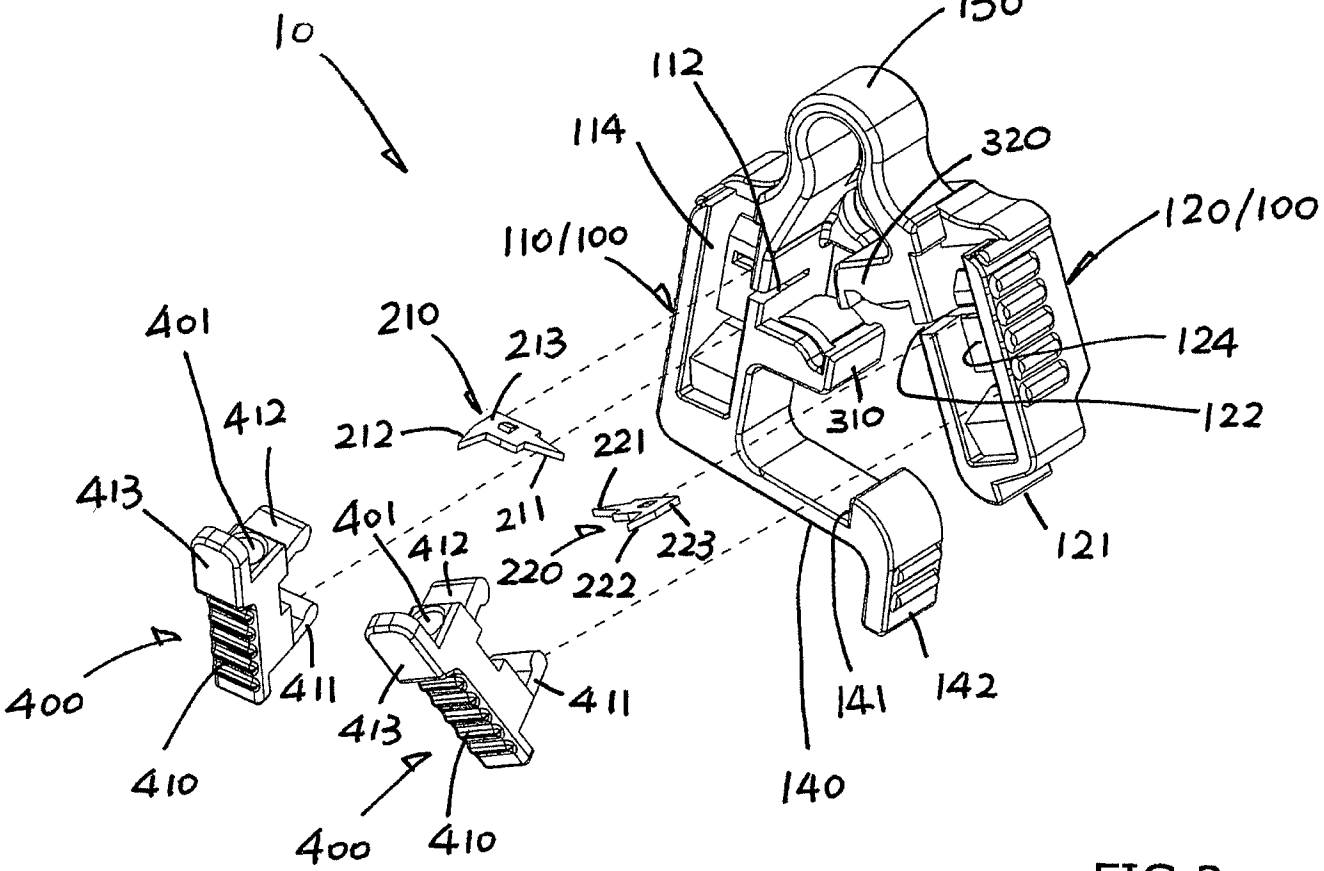
FIG. 2 is an exploded front perspective view of the electrical cable connector of FIG. 1, showing two electrical conductors therein.
Figure 3:
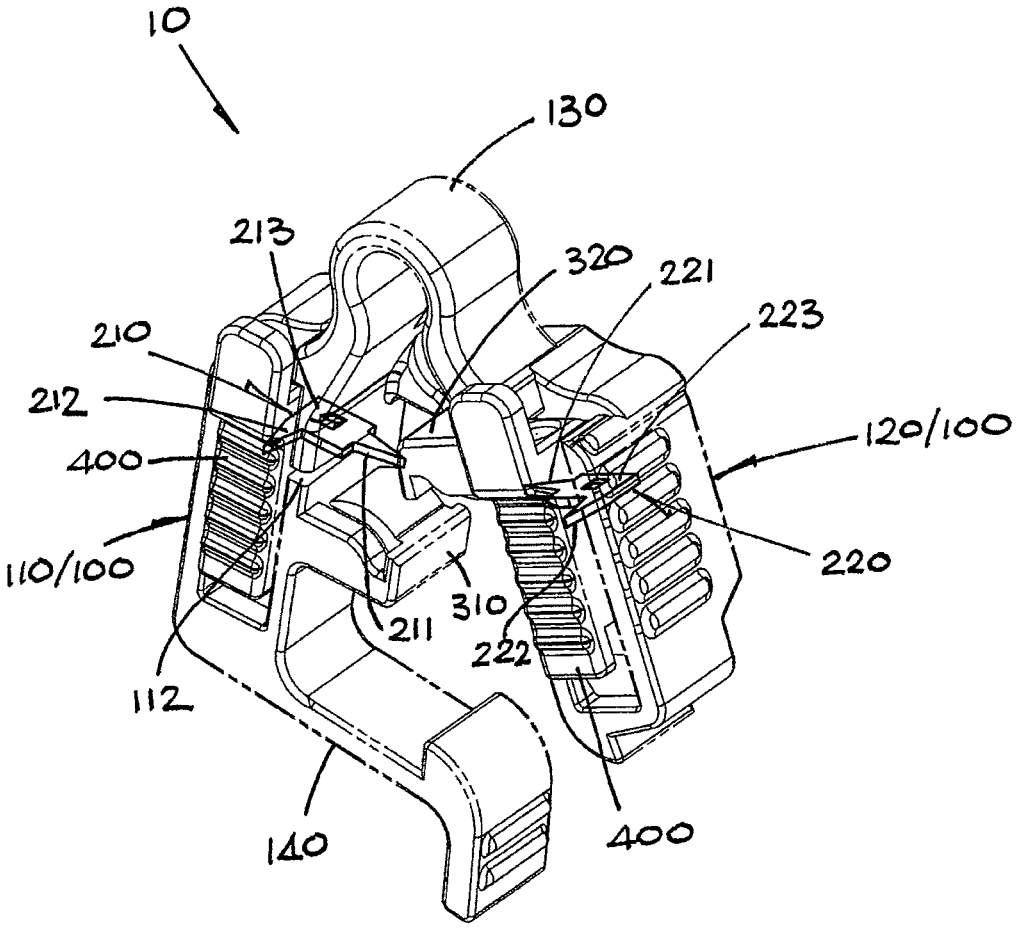
FIG. 3 is an assembled front perspective view of the electrical cable connector of FIG. 2, shown see-through to reveal the two electrical conductors.
Figure 4:
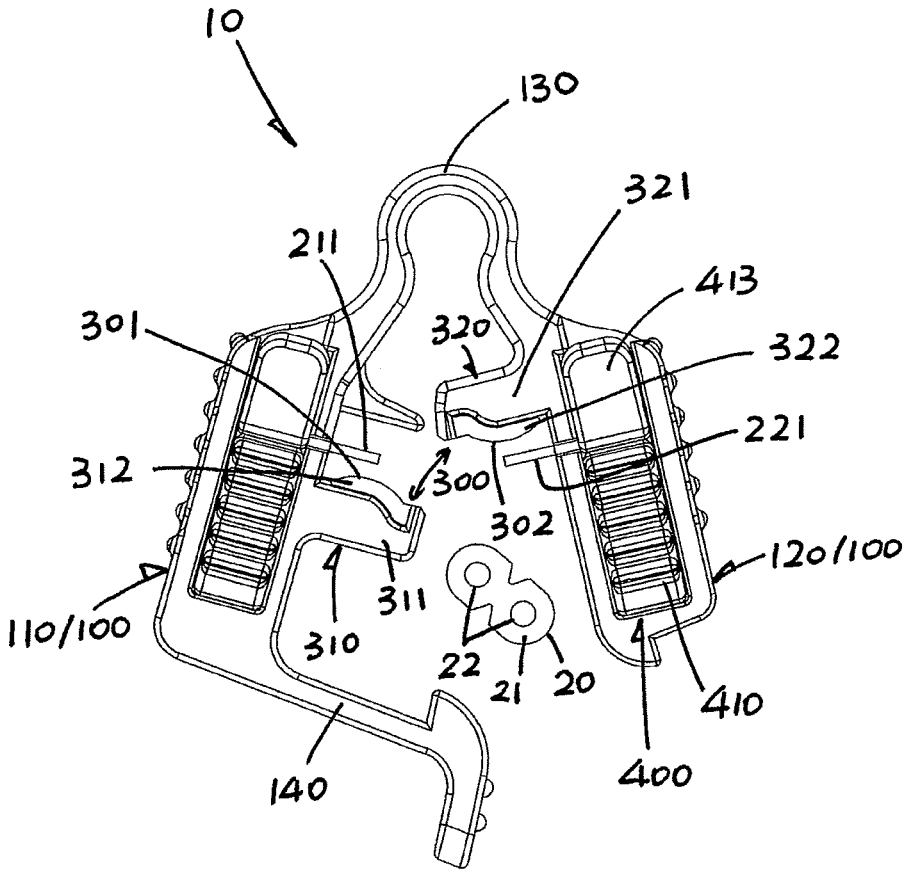
FIG. 4 is a front view of the electrical cable connector of FIG. 1, shown in an open condition and with an electrical cable for connection thereby.

Referring initially to FIGS. 1 to 12B of the drawings, there is shown a first embodiment of an electrical cable connector 10 embodying the invention for use in a landscape lighting system upon an electrical cable 20, which is connected to a 12V DC (or AC) power source, for drawing electrical power therefrom to operate a lighting fixture in a garden or the like, e.g. a garden light, via an individual electrical cable 30 connected to the garden light. The cable connector 10 serves to electrically connect the fixture cable 30 to the power cable 20. Each cable 20/30 typically has a pair of conductive cores 22/32 protected by insulation i.e. insulating sheath 21/31.

Generally stated, the cable connector 10 has a body 100, molded from plastics material for example, and first and second conductors 210 and 220, made of copper material for example, supported by the connector body 100 for establishing electrical connection between the power and fixture cables 20 and 30.

Figure 6:
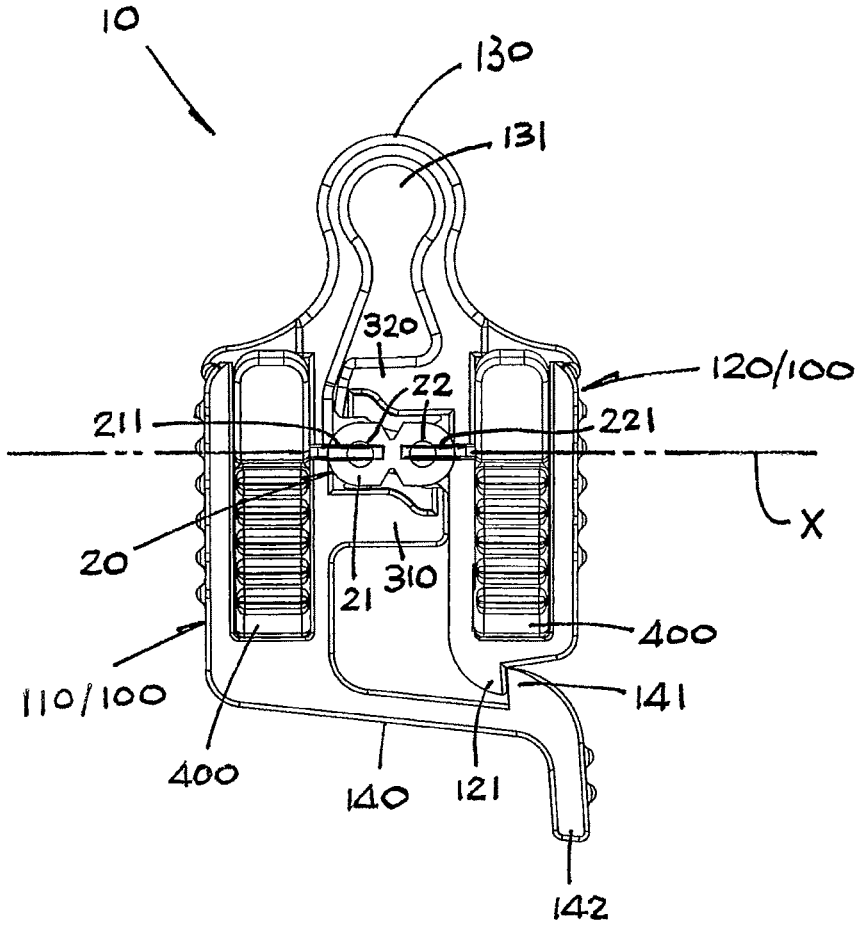
FIG. 6 is a front view of the electrical cable connector subsequent to FIG. 5, shown in a closed condition and with the electrical cable connected.
Figure 7:
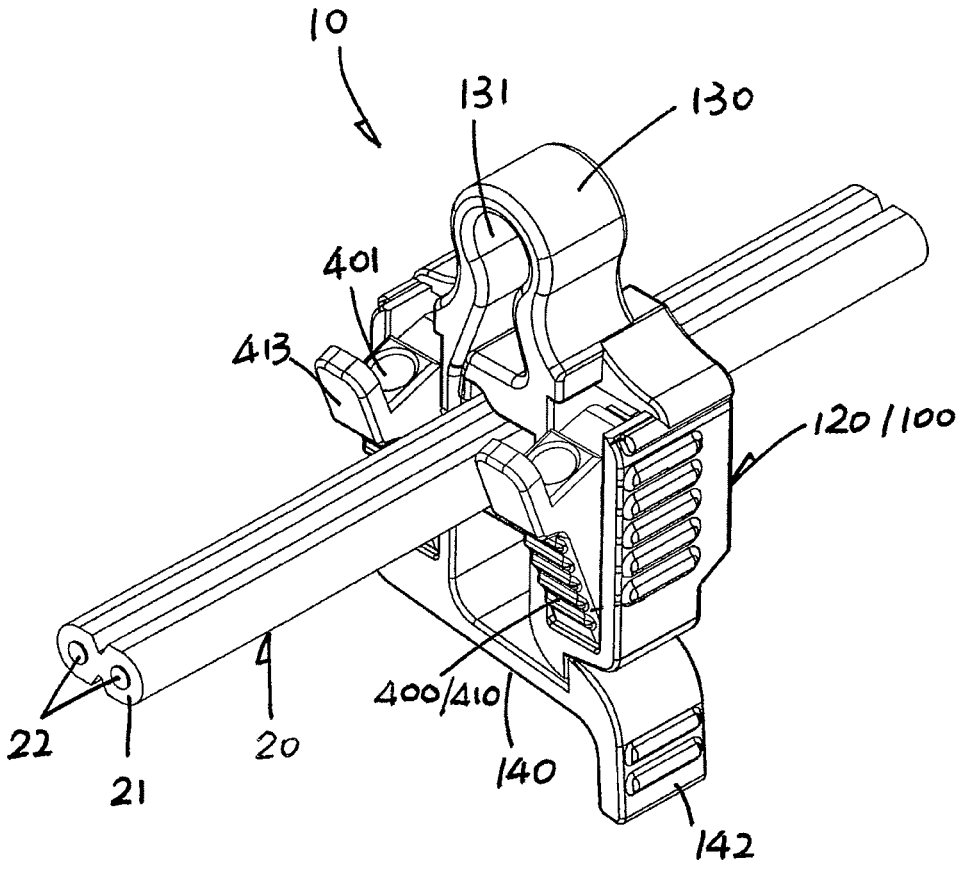
FIG. 7 is a front perspective view of the electrical cable connector of FIG. 6.
Figure 8:
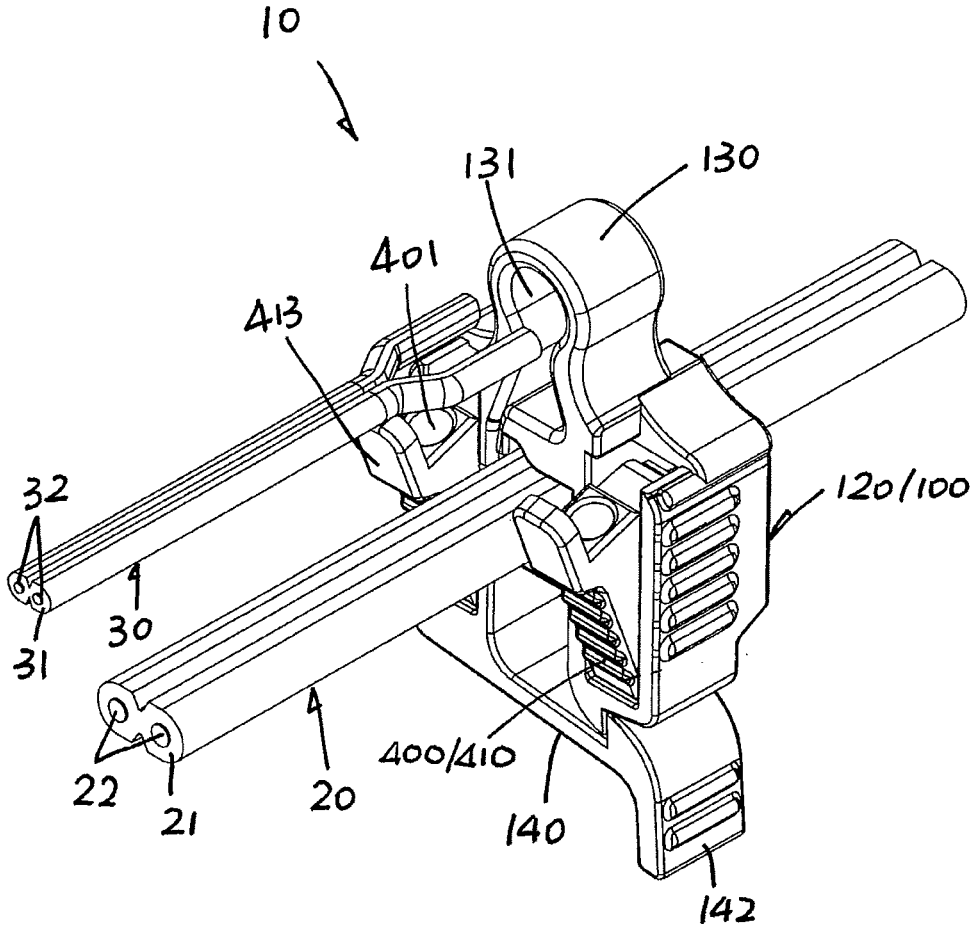
FIG. 8 is a front perspective view of the electrical cable connector of FIG. 7, with a second electrical cable for connection thereby.

The cable connector body 100 includes an oblong first body member 110 and an oblong second body member 120 which are connected together and are movable, and preferably pivotable, from an open position in which the first and second body members 110 and 120 are relatively spaced apart (FIG. 4) to a closed position in which the first and second body members 110 and 120 are relatively close together (FIG. 6). The two body members 110 and 120 are integrally connected together, at respective near or connected ends, by means of a resiliently deformable intermediate part in the form of a relatively thin band 130 which permits flexing or pivotal movement, in opposite directions, of the body members 110 and 120 between the open and the closed positions.

The band 130 is resiliently deformable and is shaped such that the two body members 110 and 120 are held by the band 130 to stay normally or at rest in the open position and are upon compression pivotable to the closed position against the resiliently biasing action of the band 130.

The first body member 110 has at its free end, as opposed to the connected end, an integral lever 140 which extends transversely to reach the free end of the second body member 120. At the free end of the lever 140 and that of the second body member 120, there are formed respective steps 141 and 121 which face in opposite directions for inter-engagement through a snap action, as permitted through slight flexing of the lever 140, when the body members 110 and 120 are pivoted to reach the closed position.

The lever 140 acts as a locking device designed to lock the first and second body members 110 and 120 in the closed position against the resiliently biasing force imparted by the band 130, which resiliently biases the first and second body members 110 and 120 towards the open position. This locking device takes the form of a releasable latch for latching, by way of inter-engagement between the associated steps 141 and 121 through a snap action, to lock the first and second body members 110 and 120 in the closed position.

This results in a locked condition, with the two body members 110 and 120 in the closed position, in which the overall connector body 100 is completely closed as between the body members 110 and 120 by the lever 140 to form a looped configuration. The band 130 is restricted to form a keyhole-shaped aperture 131.

The latch is releasable and, for this purpose, includes a releasing tab 142 provided right at the free end of the lever 140 for pressing to deform or bend the lever 140 slightly outward so as to release the latch through disengagement of the lever's step 141 from the body member's step 121, whereupon the body members 110 and 120 are instantly sprung open i.e. back to the open position. Such quick release or unlocking is convenient.

Referring to the first and second conductors 210 and 220, they are supported by the first and second body members 110 and 120 respectively. In each case, the conductor 210/220 has a generally flat profile, having a plate 213/223 with two first and second ends 211/221 and 212/222 projecting outwardly in mutually perpendicular directions. Each end 211/221/212/222 has a relatively sharp tip (or edge) for piercing through insulation 21/31 and coming into electrical connection with the respective core 22/32, as hereinafter described.

The first conductor 210 is inserted with its plate 213 in a transverse slit 112 in the first body member 110, with its first end 211 protruding and pointing generally at the second body member 120 and its second end 212 pointing to the front side of the connector body 100. Similarly, the second conductor 220 is inserted with its plate 223 in a transverse slit 122 in the second body member 120, with its first end 221 protruding and pointing generally at the first body member 110 and its second end 222 pointing also to the front side of the connector body 100.

More specifically, with the first and second body members 110 and 120 in the closed position, the two first ends 211 and 221 of the conductors 210 and 220 point in opposite directions right at each other and, in particular, along an imaginary plane X (FIG. 6).

The power cable 20 is intended to be located with a section of its two cores 22 extending through the connector body 100 and lying on the same imaginary plane X, when the first and second body members 110 and 120 are pivoted to the closed position, for electrical connection by the first ends 211 and 221 of the two conductors 210 and 220 respectively. Locating the cable section 20 in such a position involves the use of a gap 300 which is associated with both (or at least one) of the first and second body members 110 and 120, through which gap 300 the imaginary plane X extends.

The gap 300 is formed by and between a pair of opposed gap parts 310 and 320 which are provided by both (or at least one) of the first and second body members 110 and 120, one gap part 310/320 from each body member 110/120. The gap parts 310 and 320 have respective inner surfaces 301 and 302 which are resiliently movable to adjust, either increasing or reducing, the width of the gap 300. Each inner surface 301/302 is provided by a resiliently flexible plate 312/322 which alone may implement the respective gap part 310/320 (see the second embodiment), or in conjunction with a wall 311/321 on the associated body member 110/120 as in the present embodiment.

More specifically, each gap part 310/320 includes the wall 311/321 that supports the corresponding resiliently flexible plate 312/322, together implementing the gap part 310/320. The resiliently flexible plate 312/322, which is an integral part of the wall 311/312, extends downwardly from the upper end of the wall 311/321 and overlaps with the wall 311/321 but is spaced apart therefrom at a small yet adequate distance.

Figure 5:
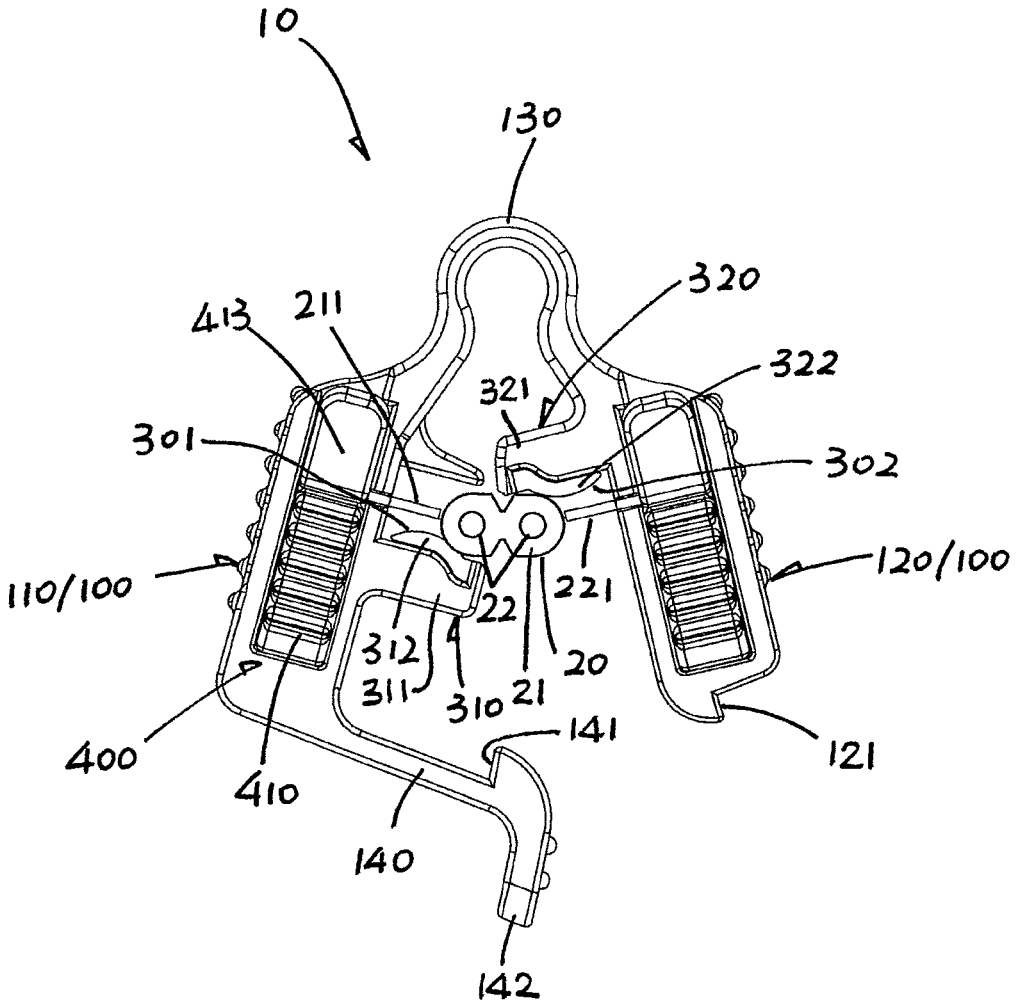
FIG. 5 is a front view of the electrical cable connector subsequent to FIG. 4, showing the electrical cable being connected.

In operation, while the cable connector 10 is open, the power cable 20 is inserted laterally into the space between the first and second body members 110 and 120 (FIG. 4) and in particular the space right between the first ends 211 and 221 of the conductors 210 and 220 (FIG. 5). Upon the first and second body members 110 and 120 being pivoted to the closed position, the conductors' first ends 211 and 221 simultaneously cut or pierce through the insulation 21 and come into electrical connection in opposite directions with the two cable cores 22 respectively, with the lever 140 finally and automatically latching the body members 110 and 120 in the closed position and hence the cable connector 10 firmly closed (FIG. 6). Cable connection is made simple and a quick operation.

As the body members 110 and 120 are pivoting together, the gap parts 310 and 320 thereon are simultaneously brought closer together to form the gap 300 locating the relevant section of the power cable 20 and hence its cores 22 in alignment, along the imaginary plane X, with the respective conductor ends 211 and 221 for electrical connection thereby through the insulation 21.

The resiliently flexible plates 312 and 322 on opposite sides in the gap 300 may be flexed slightly inwards by the cable 20 to self-adjust the width of the gap 300 for accommodating the cable 20 of a size or thickness in the upper part of a range for which the cable connector 10 is designed. Hence, the cable connector 10 is fit for use with cables of an extended range of thickness/size.

For electrical connection to the garden light, the cable connector 10 includes connecting means associated with the first and second body members 110 and 120 and adapted to electrically connect each of the first and second conductors 210 and 220 to the or a respective core of the fixture cable 30.

The connecting means is implemented by the second ends 212 and 222 of the first and second conductors 210 and 220 at the corresponding first and second body members 110 and 120, and includes a pair of identical connecting devices 400 each for connecting a respective core 32 of the fixture cable 30 to the second end 212/222 of the corresponding conductor 110/120. Each connecting device 400 is implemented by an oblong movable member 410 mounted partially in a rectangular recess 114/124 on the associated body member 110/120 and adjacent the second end 212/222 of the related conductor 210/220.

Each movable member 410 has an engaging part in the form of a recess or hole 401 adapted to receive and engage the end of a respective core 32 of the fixture cable 30. The movable member 410 includes a lower prong 411 pivotally engaged or hinged within the lower end of the body member recess 114/124 such that the movable member 410 is pivotable into or out of the recess 114/124, and an upper prong 412 for snapping within the upper end of the recess 114/124 to lock the movable member 410 inside the recess 114/124. A tab 413 at the top of the movable member 410 may be pressed to unlock and pivot the movable member 410 out from the recess 114/124, thereby exposing the hole 401 for insertion (or withdrawal) of the end of the cable core 32.

Figure 9:
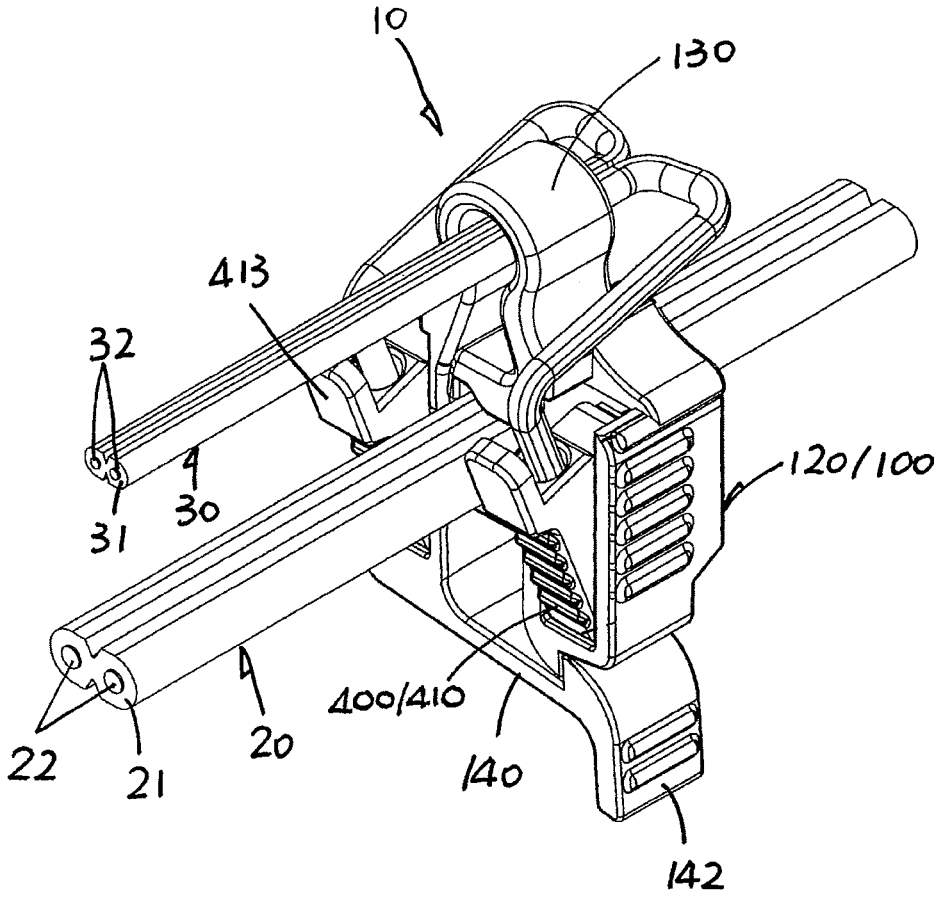
FIG. 9 is a front perspective view of the electrical cable connector subsequent to FIG. 8, showing the second electrical cable being connected.
Figure 10:
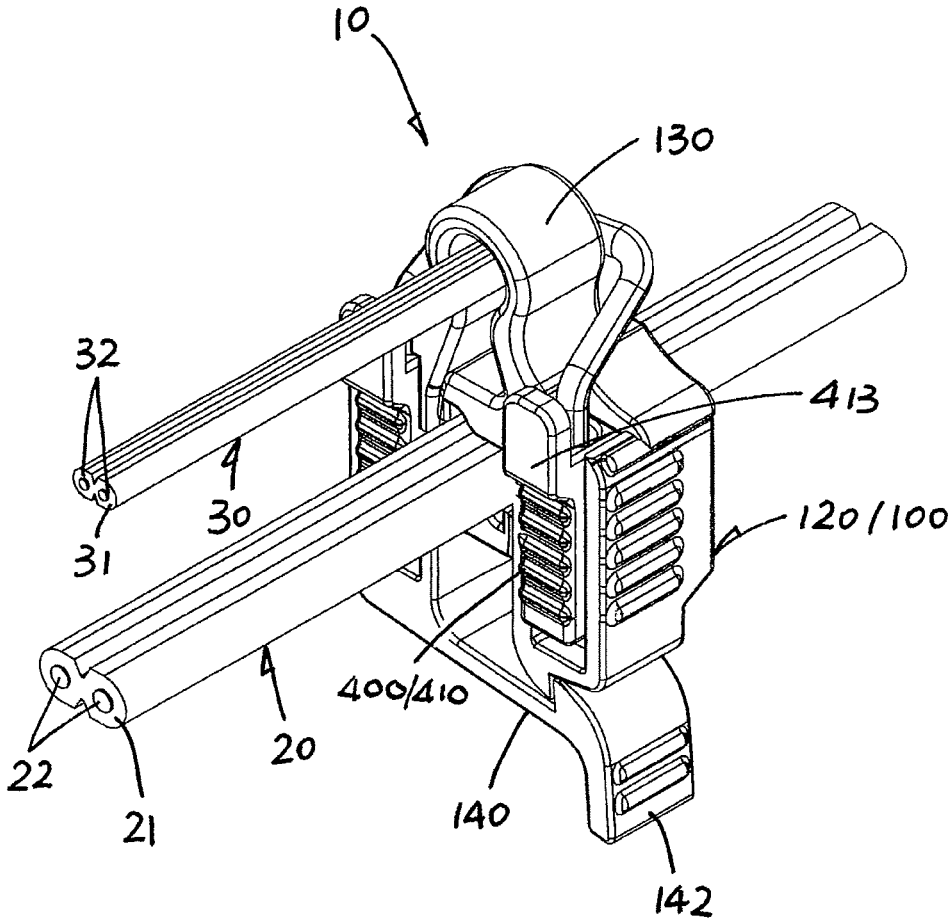
FIG. 10 is a front view of the electrical cable connector subsequent to FIG. 9, showing the second electrical cable connected.
Figure 11A:
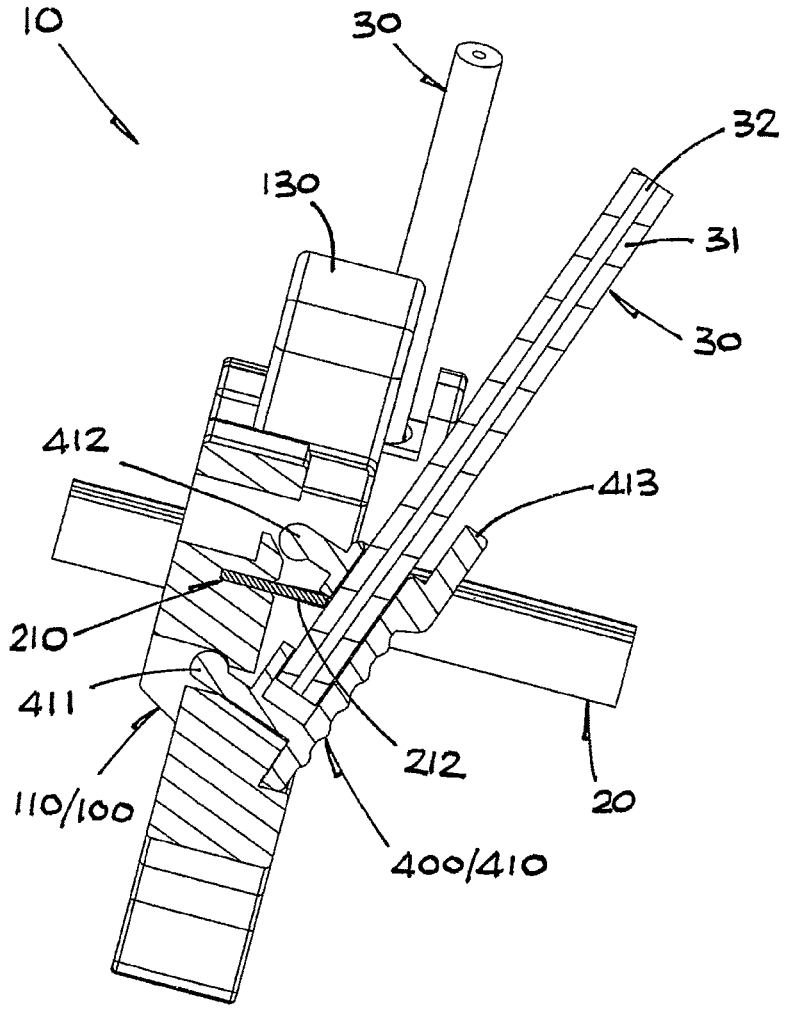
FIGS. 11A and 11B are cross-sectional views of the electrical cable connector, showing connection of the second electrical cable in conditions corresponding to those of FIGS. 9 and 10 respectively.
Figure 11B:
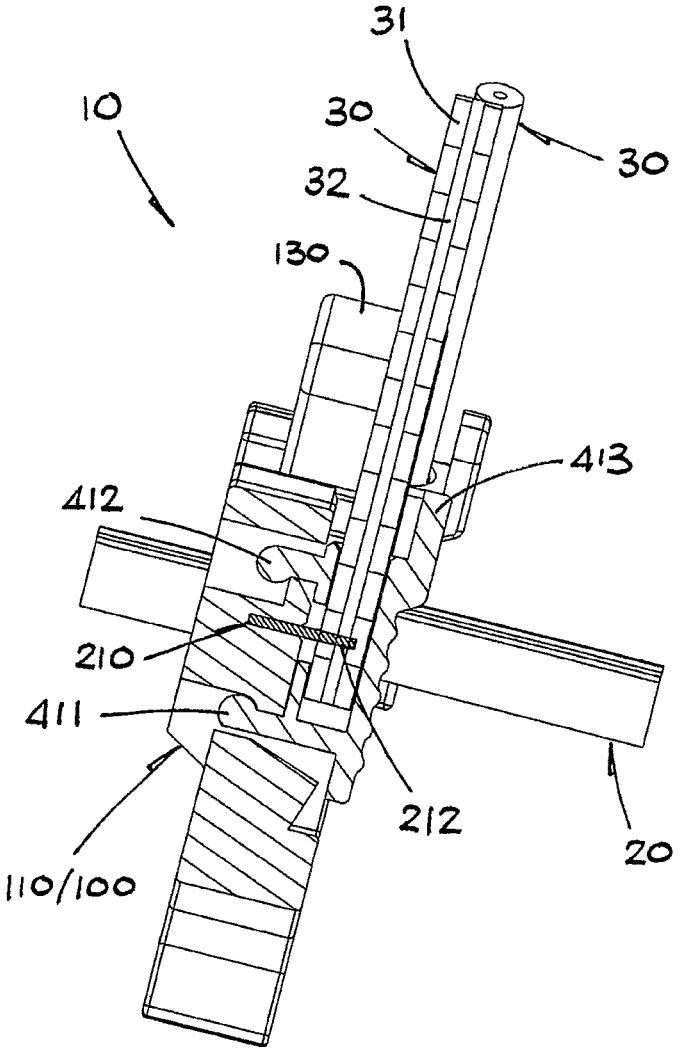
Figure 12A:
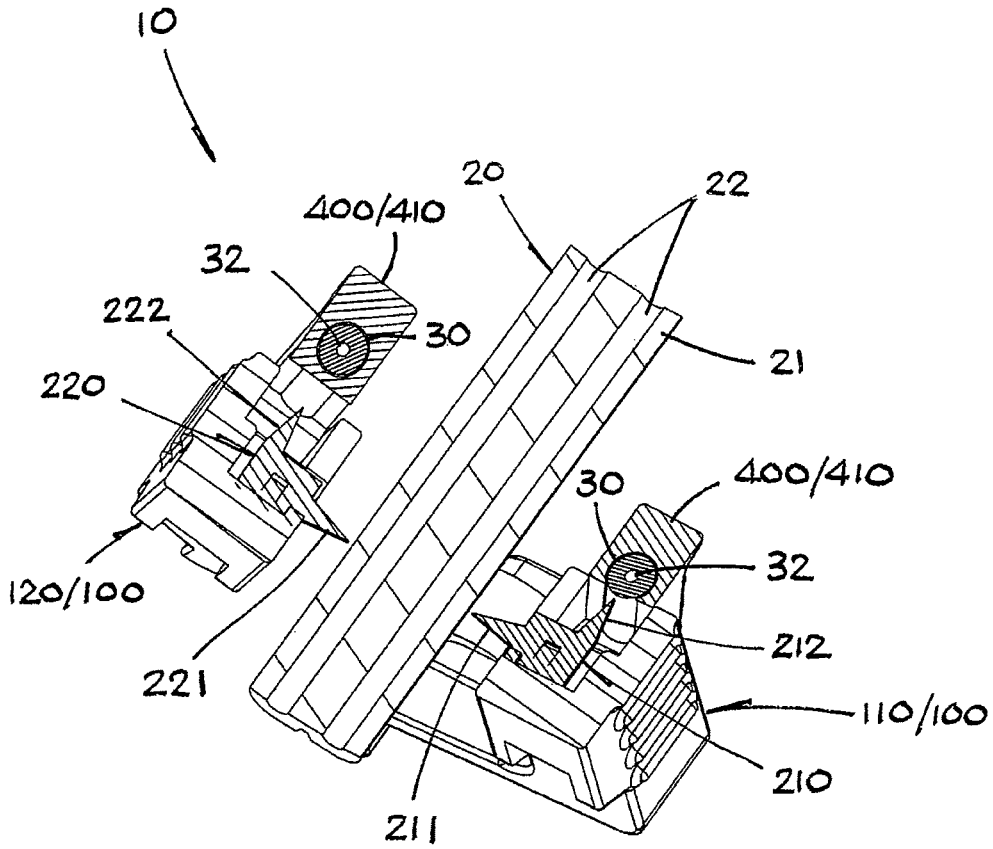
FIGS. 12A and 12B are cross-sectional views of the electrical cable connector, showing connection of the second electrical cable in stages sequentially from FIGS. 9 to 10.
Figure 12B:
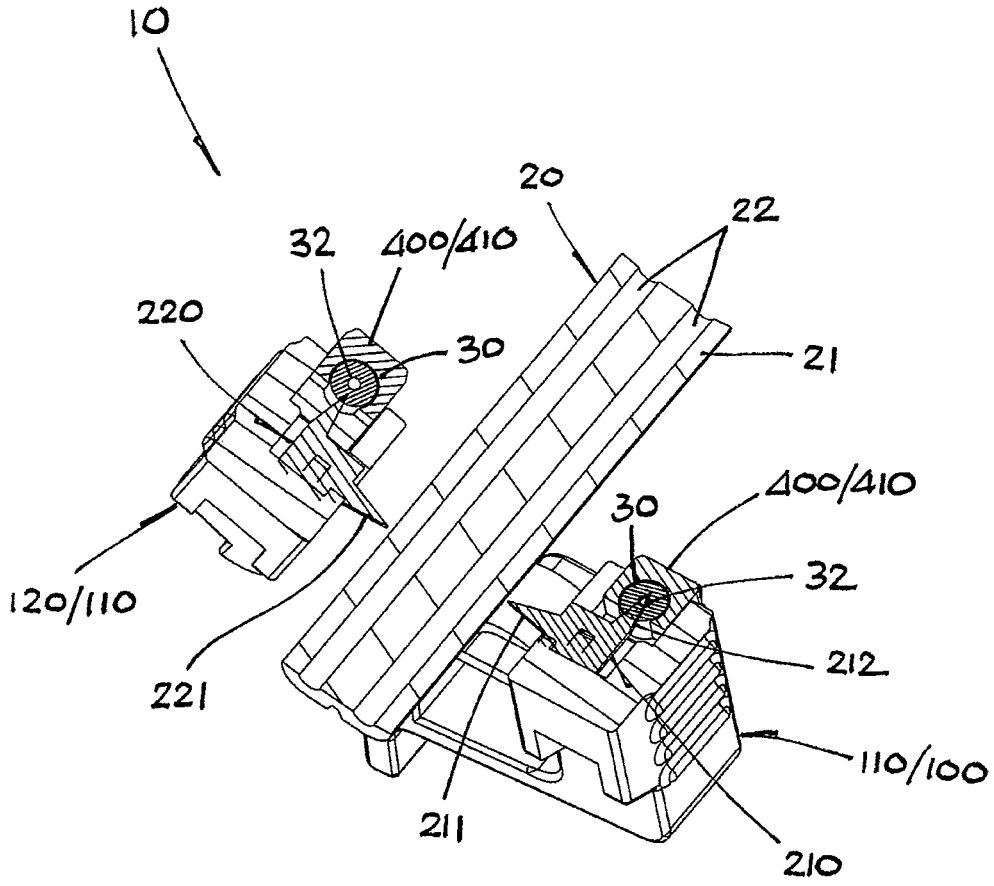

In operation of each connecting device 400, while the movable member 410 is in the outer position, the fixture cable core 32 is inserted with its end fully into the hole 401 (FIG. 9). The movable member 410 is then pivoted into the recess 114/124 (FIG. 10), whereupon the movable member 410 brings the cable core end close to and pushes it against the second end 212/222 of the corresponding first/second conductor 110/120, with the conductor end 212/222 simultaneously cutting or piercing through the insulation 31 and coming into electrical connection with the cable core 32 (FIGS. 11A to 11B), until the movable member 410 is fully pushed into the recess 114/124 and firmly locked therein.

To reinforce the attachment of the fixture cable 30 to the cable connector 10, the fixture cable 30 may first be threaded through the keyhole-shaped aperture 131 provided by the band 130 (FIG. 8) before its cores 32 are electrically connected as described above.

Figure 13:
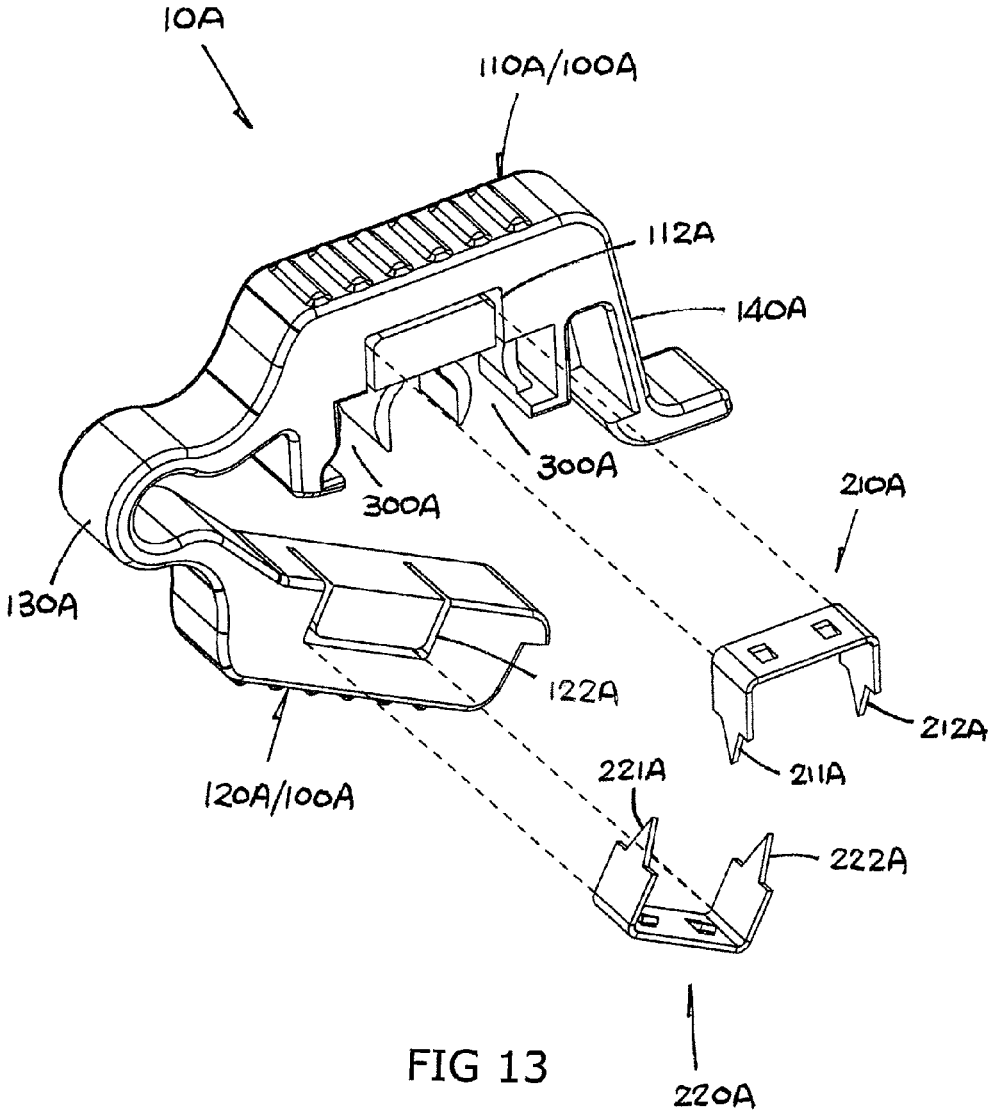
FIG. 13 is a front perspective view of a second embodiment of an electrical cable connector in accordance with the invention.
Figure 14:
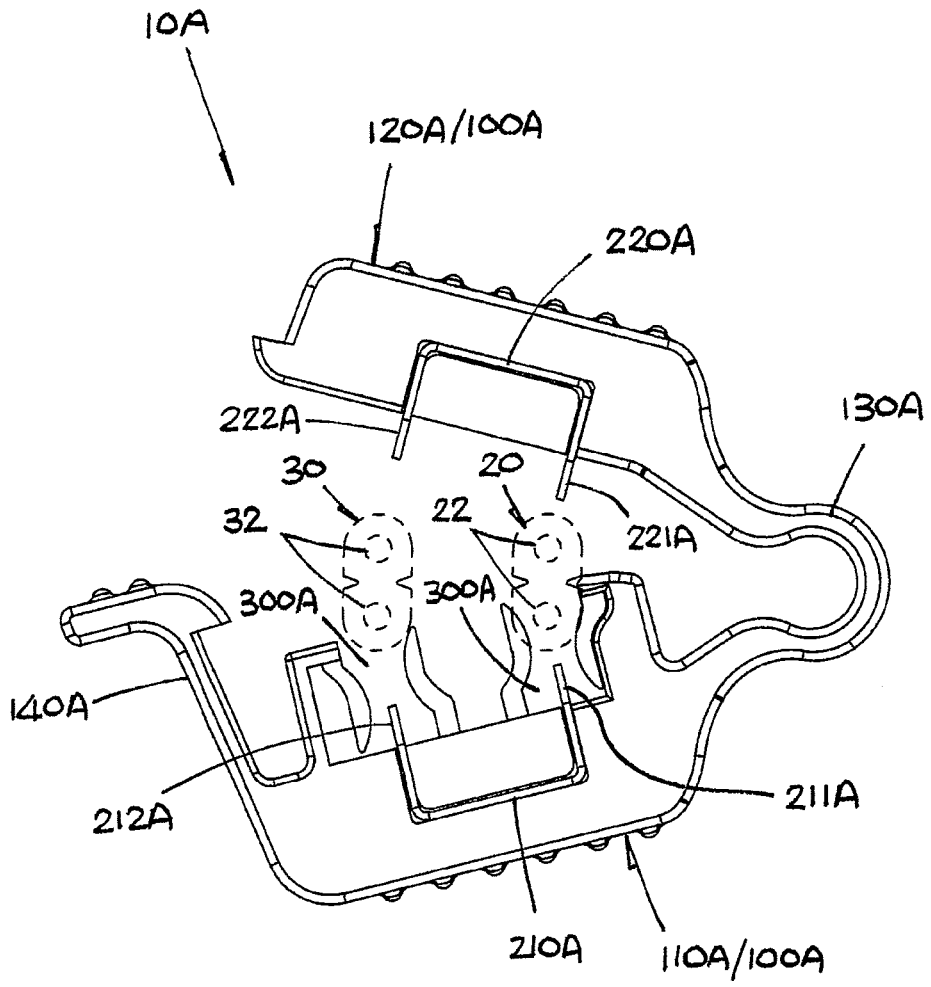
FIG. 14 is a front view of the electrical cable connector of FIG. 13, shown in an open condition and with two electrical cables for connection thereby.
Figure 15:
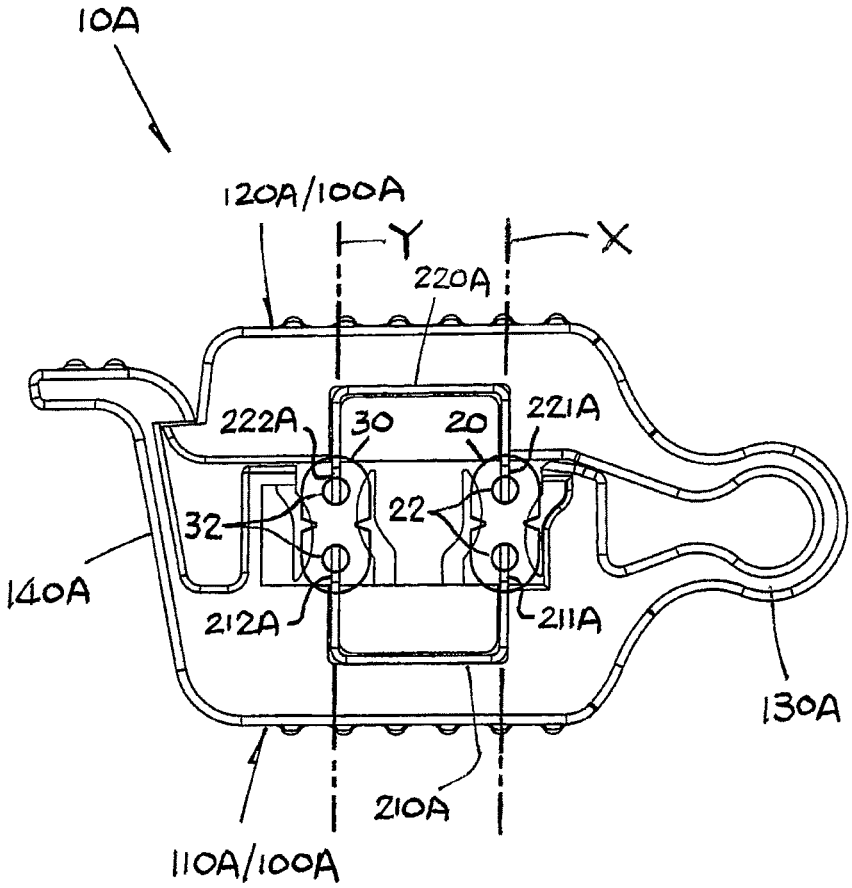
FIG. 15 is a front view of the electrical cable connector subsequent to FIG. 14, shown in a closed condition and with the two electrical cables connected.

Reference is now made to FIGS. 13 to 15 of the drawings, there is shown a second embodiment of an electrical cable connector 10A embodying the invention, which has a similar construction as the first electrical cable connector 10 described above unless otherwise stated, with equivalent parts designated by the same reference numerals suffixed by a letter "A".

In the second cable connector 10A, the connector body 100A is likewise formed by a pair of first and second body members 110A and 120A which are interconnected by an integral band 130A, support respective conductors 210A and 220A, and include a gap 300A for connecting the power cable 20 in generally the same manner as described previously. There is a minor difference in this regard, in that the two gap parts 310A and 320A forming the gap 300A are provided by only one of the body members 110A and 120A, i.e. the second body member 120A, such that the gap 300A is always present and ready for use even when the connector body 100A is in the open condition.

As a major difference in this cable connector 10A, the previous connecting devices 400/movable members 410 and related recesses 114/124 on the body members have been omitted and are replaced by a different connecting means. Although the fixture cable 30 is connected differently, it is now connected in the same manner as the power cable 20, and simultaneously in a unitary operation, thereby making quick cable connection possible. To achieve this, there is provided a second gap 300A associated with the body members 110A and 120A for connecting the fixture cable 30, of the same construction as and provided next to the first gap 300A.

The two gaps 300A do not share the same construction with the previous gap 300. In the present case, each gap 300A is formed between a pair of opposed gap parts 310A and 320A which are both formed on the second body member 120A. Thus, the two pairs of gap parts 310A and 320A both protrude from the inner side of the second body member 120A. There is also another change, in that whilst one gap part 310A is likewise provided by a wall 311A with an integrally-connected resiliently flexible plate 312A, the other gap part 320A is implemented only by a resiliently flexible plate 322A alone, which protrudes directly from the associated body member 120A.

In any event, both of the gaps 300A are made to keep the function of self-adjusting their gap width to accommodate cables of an extended range of thickness/size, for connection of power cables as well as fixture cables.

The two gaps 300A for connecting respective cables 20 and 30 are arranged side-by-side, and this warrants a similar arrangement as between opposite ends 211A/221A and 212A/222A of the first and second conductors 210A and 220A. More specifically, each conductor 210A/220A is now made from a rectangular U-shaped strip and is located in a corresponding slit 112A/122A of a matching shape in the respective first/second body member 110A/120A. The slit 112A/122A is flatter (i.e. having shorter legs) so as to expose opposite ends 211A/221A and 212A/222A of the conductor 210A/220A, which in turn protrude in the same direction from the associated body member 110A/120A and point at or towards the respective gaps 300A.

Generally stated, the connecting means for connecting the fixture cable 30 includes respective second ends 212A and 222A of the two conductors 210A and 220A protruding from the corresponding first and second body members 110A and 120A and pointing in opposite directions along a second imaginary plane Y when the body members 110A and 120A are in the closed position. Also included is a second gap 300A, of identical construction as the first-mentioned gap 300A for the power cable 20, through which second gap 300A a second imaginary plane Y (parallel to the first imaginary plane X) extends, for receiving and locating a section of two cores 32 with insulation of the fixture cable 30 on the same second imaginary plane Y when the body members 110A and 120A are pivoted to the closed position. As the body members 110A and 120A are being closed, the second ends 212A and 222A of the two conductors 210A and 220A will simultaneously cut through the insulation and come into electrical connection, in opposite directions, with the respective cable cores 32.

It is understood that the same operation as described in the preceding paragraph also applies to the connection of the power cable 20, and will take place simultaneously as the power and fixture cables 20 and 30 are connected by the cable connector 10A (FIGS. 15 to 16) to complete the power supply circuit for the garden light.

Figure 16:
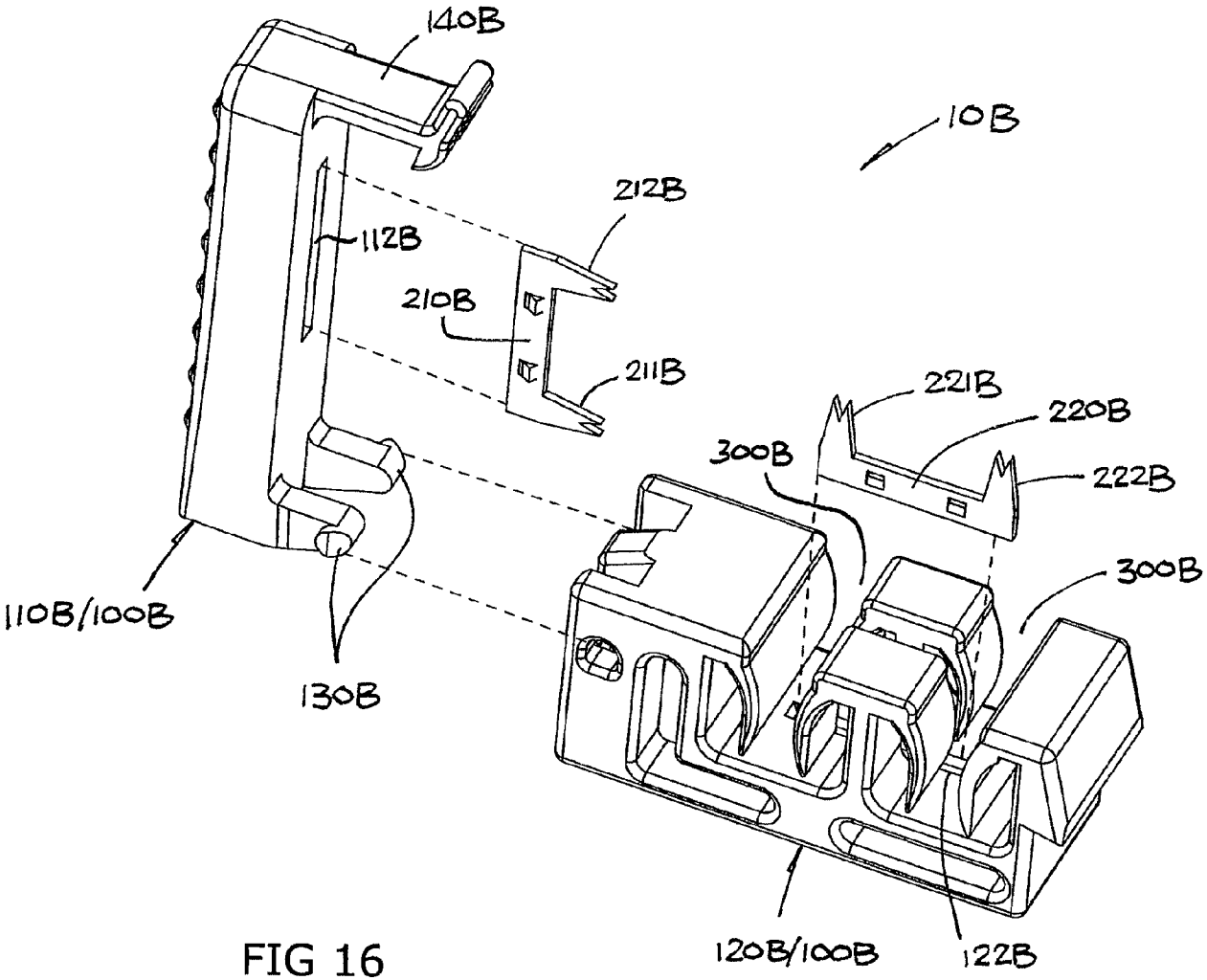
FIG. 16 is a front perspective view of a third embodiment of an electrical cable connector in accordance with the invention.
Figure 17:
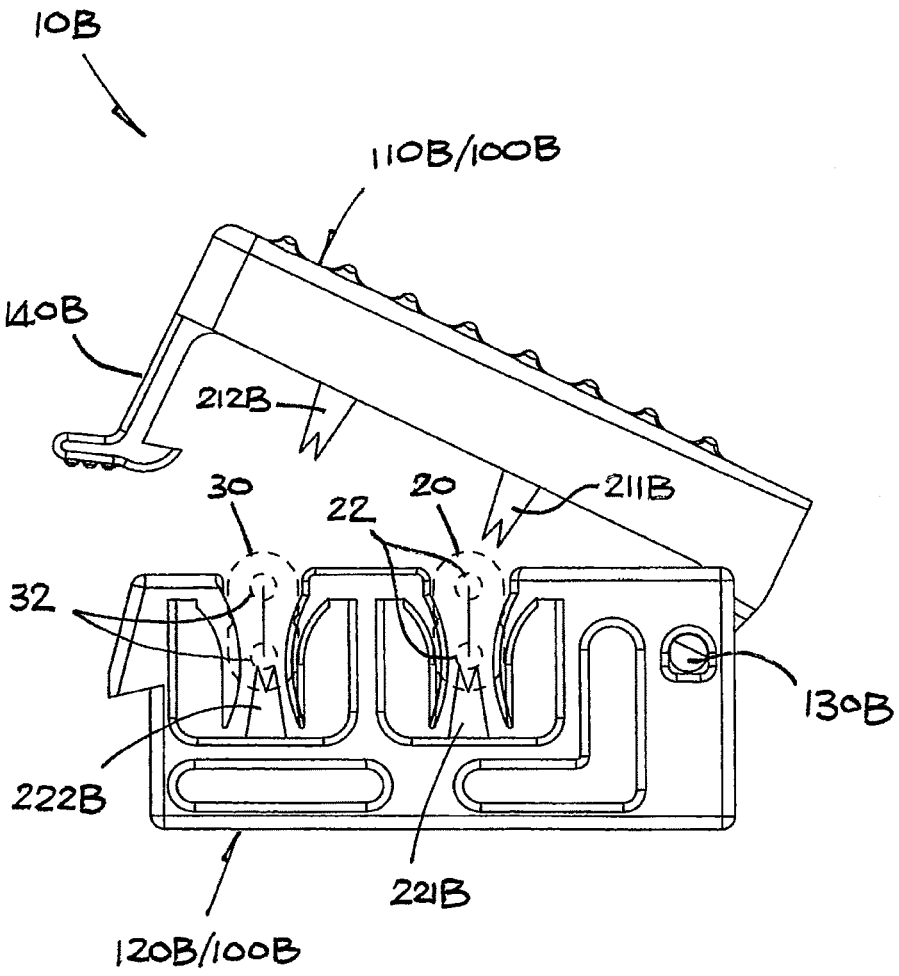
FIG. 17 is a front view of the electrical cable connector of FIG. 16, shown in an open condition and with two electrical cables for connection thereby.
Figure 18:
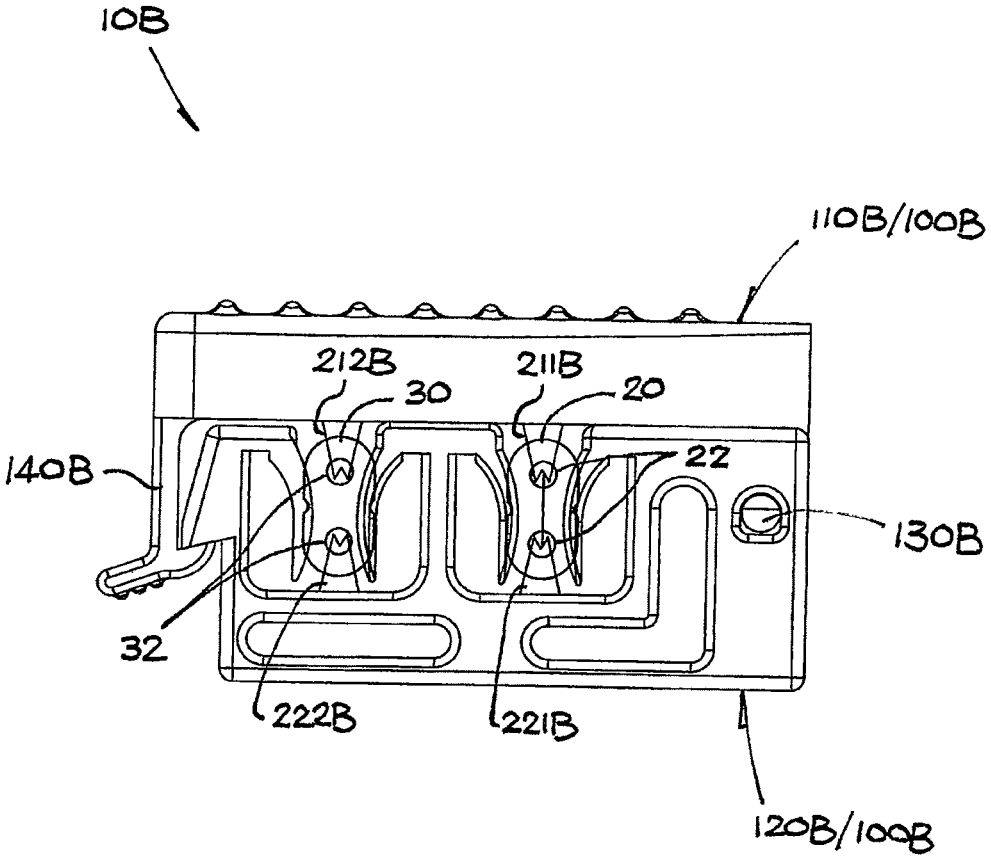
FIG. 18 is a front view of the electrical cable connector subsequent to FIG. 17, shown in a closed condition and with the two electrical cables connected.

Referring briefly to the remaining FIGS. 16 to 18 of the drawings, there is shown a third embodiment of an electrical cable connector 10B embodying the invention, which has a similar construction as the second electrical cable connector 10A described above unless otherwise stated, with equivalent parts designated by the same reference numerals suffixed by a letter "B" in place of "A".

The third cable connector 10B is made relatively larger and physically stronger for heavier duty tasks, e.g. use on thicker cables. One major difference lies in the connector body 100B being formed by a pair of distinct (i.e. separate) first and second body members 110B and 120B which are connected together by means of a hinge connection 130B (e.g. hinge pin or equivalent structure). The hinge connection 103B permits wider opening between the body members 110B and 120B.

As is appreciated from the foregoing description, the subject electrical cable connector has a minimal construction and is simple and quick to use. It is also capable of self-adjustment, and without use of any tool, to allow for connection of cables of an extended range of thickness/size.

The invention has been given by way of example only, and various other modifications of and/or alterations to the described embodiments may be made by persons skilled in the art without departing from the scope of the invention as specified in the appended claims.

The invention claimed is:

1. An electrical cable connector for electrically connecting a first electrical cable having two cores with insulation to a second cable, comprising:

a body having first and second body members which are connected together and are movable between an open position of the body, in which the first and second body members are relatively spaced apart, and a closed position of the body, in which the first and second body members are relatively close together;

a first conductor supported by the first body member and a second conductor supported by the second body member, the first and second conductors having respective ends protruding from respective first and second body members, the ends extending in opposite directions in an imaginary plane in the closed position of the body;

a first gap associated with at least one of the first and second body members, through which the imaginary plane extends, for receiving and locating a section of the two cores of the first electrical cable in the imaginary plane when the first and second body members are moved to the closed position of the body, with the ends of the first and second conductors simultaneously cutting through the insulation and respectively coming into electrical connection, in opposite directions, with the two cores; and connecting means associated with the first and second body members and electrically connecting each of the first and second conductors to a respective core of the second electrical cable.

2. The electrical cable connector as claimed in claim 1, wherein the first and second body members are connected together for pivotal movement and are pivotable from the open position of the body to the closed position of the body.

3. The electrical cable connector as claimed in claim 2, wherein the first and second body members are distinct parts and are connected together by a hinge connection.

4. The electrical cable connector as claimed in claim 2, wherein the first and second body members are integral parts and are integrally connected together by a resiliently deformable intermediate part.

5. The electrical cable connector as claimed in claim 1, wherein the body has a looped configuration when the first and second body members are in the closed position of the body.

6. The electrical cable connector as claimed in claim 1, wherein the body includes a locking device for locking the first and second body members in the closed position of the body against a resiliently biasing force which resiliently biases the first and second body members towards the open position of the body.

7. The electrical cable connector as claimed in claim 6, wherein the locking device comprises a releasable latch latching the first and second body members in the closed position of the body, and the releasable latch includes a releasing part that is deformed to release the latch.

8. The electrical cable connector as claimed in claim 1, wherein the first gap is located between two opposed gap parts that are portions of at least one of the first and second body members.

9. The electrical cable connector as claimed in claim 8, wherein the two opposed gap parts are respective portions of the first and second body members.

10. The electrical cable connector as claimed in claim 8, wherein the two opposed gap parts are both parts of the second body member.

11. The electrical cable connector as claimed in claim 8, wherein at least one of the two opposed gap parts has an inner surface which is resiliently movable to adjust width of the first gap.

12. The electrical cable connector as claimed in claim 11, wherein the inner surface of the at least one of the two opposed gap parts includes a resiliently flexible plate.

13. The electrical cable connector as claimed in claim 12, wherein the resiliently flexible plate implements at least one of the gap parts.

14. The electrical cable connector as claimed in claim 12, wherein the at least one of the two opposed gap parts includes a wall on an associated body member supporting the resiliently flexible plate, and the wall and the resiliently flexible plate together implement at least one of the two opposed gap parts.

15. The electrical cable connector as claimed in claim 1, wherein the connecting means comprises respective second ends of the first and second conductors protruding from corresponding first and second body members and pointing in opposite directions, in a second imaginary plan; when the first and second body members are in the closed position of the body, and a second gap, through which the second imaginary plane extends, for receiving and locating a section of two cores with insulation of the second electrical cable, in the second imaginary plan, when the first and second body members are moved to the closed position of the body, with second ends of the first and second conductors simultaneously cutting through insulation and respectively coming into electrical connection, in opposite directions, with the two cores of the second electrical cable.

16. The electrical cable connector as claimed in claim 1, wherein the connecting means comprises respective second ends of the first and second conductors at the first and second body members, and a connecting device for connecting a respective core of the second electrical cable to the second end of at least one of the first and second conductors.

17. The electrical cable connector as claimed in claim 16, wherein the connecting device comprises a movable member on one of the first and second body members and adjacent the second end of one of the first or second conductors, and the movable member has an engaging part for engaging a respective core of the second electrical cable and, upon movement of the movable member, to connect to the second end of one of the first and second conductors.

18. The electrical cable connector as claimed in claim 17, wherein the movable member is in pivotal engagement with one of the first and second body members to connect a respective core of the second electrical cable to the second end of one of the first and second conductors.

19. The electrical cable connector as claimed in claim 17, wherein the engaging part has a hole or recess for receiving a respective core of the second electrical cable.

20. The electrical cable connector as claimed in claim 17, wherein the connecting device comprises pair one of the movable members on each of the first and second body members, respectively, for connecting the cores of respective second electrical cables or respective cores of the second electrical cable, to the second ends of the first and second conductors, respectively.

21. The electrical cable connector as claimed in claim 1, wherein each end of at least one of the first and second conductors has a relatively sharp tip or edge for piercing insulation and coming into electrical connection with a respective core.

* * * * *